US008127784B2

(12) United States Patent
Cesarz

(10) Patent No.: US 8,127,784 B2
(45) Date of Patent: Mar. 6, 2012

(54) FILTER DRAINING DEVICE

(76) Inventor: Matthew Simon Cesarz, Alvin, TX (US)

( * ) Notice: Subject to any disclaimer, the term of this patent is extended or adjusted under 35 U.S.C. 154(b) by 380 days.

(21) Appl. No.: 12/362,705

(22) Filed: Jan. 30, 2009

(65) Prior Publication Data

US 2009/0308464 A1 Dec. 17, 2009

Related U.S. Application Data

(60) Provisional application No. 61/061,967, filed on Jun. 16, 2008.

(51) Int. Cl.
*B25B 27/00* (2006.01)
*F01M 11/04* (2006.01)

(52) U.S. Cl. ..... 137/15.13; 137/318; 210/248; 141/330

(58) Field of Classification Search ..... 137/317, 137/318, 15.12, 15.13; 141/330, 329; 83/30, 83/660; 222/1, 81, 83, 91; 210/248, 233, 210/313

See application file for complete search history.

(56) References Cited

U.S. PATENT DOCUMENTS 2,875,777 A * 3/1959 Lacart ..... 137/318
3,438,656 A * 4/1969 Fritch ..... 137/318
3,762,263 A * 10/1973 Bocceda ..... 83/30
4,177,529 A * 12/1979 Sikula, Jr. ..... 141/330
5,133,234 A 7/1992 Ehlert et al.
5,299,714 A 4/1994 Kilgore
5,325,771 A 7/1994 Morris
5,421,223 A 6/1995 Wawrzyniak
5,546,979 A * 8/1996 Clark et al. ..... 137/318
5,558,140 A 9/1996 Clark, II
5,598,951 A 2/1997 DeBano, Jr.
5,694,990 A 12/1997 Crima
5,896,886 A 4/1999 Wendt
6,056,874 A 5/2000 Goodman
7,077,177 B2 7/2006 Awad
7,846,330 B2 * 12/2010 Nelson ..... 210/233
2005/0016627 A1 1/2005 Awad
2005/0133065 A1 6/2005 Kincaid et al.
2007/0251074 A1 11/2007 Reinosa et al.

* cited by examiner

*Primary Examiner* — Kevin Lee
(74) *Attorney, Agent, or Firm* — Mark L. Cooper

(57) ABSTRACT

Disclosed herein is a device for draining a screw-on fluid filter which comprises a hollow body member movably engaged with a puncturing member. The hollow body member is dimensioned and arranged to at least partially engage a threaded attachment portion of the screw-on fluid filter. The puncturing member comprises a shaft having a puncture end movable within a conduit formed within the hollow body member wherein the puncturing member may be engaged with an inner side of a fluid filter to produce a puncture hole from inside out of the fluid filter, to produce a puncture hole from which fluid in the fluid filter may drain. A method of using the device is also disclosed.

20 Claims, 6 Drawing Sheets

44
70
66
42
14
60
18

44
44
44
68
68
66
42
14
80
60
18

44
78
42
14
76
60
18

FILTER DRAINING DEVICE

CROSS-REFERENCE TO RELATED APPLICATION

The present application claims priority to Provisional U.S. patent application Ser. No. 61/061,967 filed Jun. 16, 2008 and is herein incorporated by reference.

BACKGROUND OF THE INVENTION

The instant invention relates to an apparatus and a method of draining a fluid filter. In particular, a device for puncturing and draining oil from an oil filter.

Various fluids utilized in mechanical devices require filtering to remove particulate matter therefrom. Filtration is often preformed using disposable filters which are removed and replaced. As such, fluid filters must be removed and replaced in a variety of applications. For example, automobile engines require oil to lubricate and cool moving parts. Oil prevents excess wear, increases efficiency and lengthens engine life. However, engine oil breaks down with use over time, and oil picks up particulate contaminates caused by engine wear that can score engine parts, also reducing engine efficiency and engine life. These particulates are removed using a disposable screw-on filter, commonly referred to as an oil filter. For proper maintenance of automotive engines, the oil and oil filter must be changed regularly.

Since an automobile engine's oil filter must be changed regularly, the vast majority of today's cars and light-duty trucks utilize a disposable, spin-on type oil filter. These filters are available at thousands of automobile parts stores and can be easily replaced by individuals using simple tools. Individuals who change their own oil and oil filters are commonly know as Do-It-Yourself Oil Changers (DIY's).

1 in 5 households have a Do-It-Yourself oil changer such that over 60 million American DIY's generate over 200,000,000 used oil filters annually. An undrained oil filter can contain from 8 ounces to 64 ounces of used oil when removed from an engine. However, a properly drained used oil filter contains only one to eight ounces of residual oil.

It is for this reason that the United States Environmental Protection Agency (EPA) recommends the used oil filter be punctured and hot-drained before recycling or disposal. The method recommended by the EPA requires a DIY to carefully puncture a hole in either the dome end of the oil filter, or through the anti-drain back valve, with a screwdriver or other sharp tool from the outer side of the oil filter inward. Once the filter is punctured, it should be placed in or on a used oil collection container such as a drip pan and be allowed to drain to remove waste oil contained therein.

However, puncturing an oil filter in this matter may result in the oil or being spilled from the filter, and/or the hot oil coming in contact with human skin which may result in an injury.

A number of references are generally directed to removing oil from an oil filter. Examples of interest include U.S. Patent Publication No. 2007/0251074, generally directed to an invention that attaches to the bottom of the used filter in a one-way locked fashion. It can be described as a concave surface, equipped with a plurality of one-way locking barbs, or locking means, that upon a quick insertion, or turning process into the normally provided center threaded channel of a spin-on oil filter, makes positive seal against the normally provided gasket in oil filters, transforming the filter into a sealed container or cylinder. This invention is also equipped with a time-release oil-eating bacteria, or other suitable biological agent, to eventually render the filter residual oil inert to the environment if the filter is still illegally dumped. Therefore, the device prevents the oil filter from leaking shortly after it is removed and substantially hot drained, to facilitate transportation to a suitable recycling or collection center, thereby enabling the recovery and recycling of used oil filters.

Also present in the art is U.S. Pat. No. 5,598,951, generally directed to a device for draining an engine's oil filter before removal of the filter from the engine, in order to minimize oil spillage from the filter during its removal from the engine. This device includes a hollow shaft having a closed end and an open end, a piercing point attached to the shaft at the open end, a flexible polymeric boot attached to the shaft adjacent to and enshrouding the piercing point, and a polymeric covering enveloping the shaft between the closed end and the portion where the flexible polymeric boot is attached.

Other examples include U.S. Pat. No. 5,558,140, generally directed to a fluid container draining device for draining fluid from a fluid container, an oil filter, in a controlled manner. The fluid container draining device has a threaded screw with a sharpened tip and a channel communicating between an opening at a forward end of the screw and a rear region of the threaded screw. When the screw is turned it will penetrate the wall of the fluid container and enter the fluid containing cavity of the fluid container. The threaded screw has a radially extending abutment surface to provide fluid tight sealing between the screw and the fluid container's walls to prevent fluid leakage. A fluid valve is positioned at the rear region of the screw to provide fluid flow control between the interior of the fluid container and outside the fluid container. The fluid valve is provided with a fitting for connection to a suction line to thereby permit fluid to be evacuated from the fluid container.

Other references of interest include U.S. Patent Application Nos.: 2005/0133065 and 2005/0016627; and U.S. Pat. Nos. 5,133,234; 5,299,714; 5,325,771; 5,421,223; 5,694,990; 5,896,886; 6,056,874, and 7,077,177.

However, the art is directed to puncturing the oil filter from the outer side-in, which may result in various environmental and safety concerns. A need exists for a safe effective method of removing oil from an oil filter.

SUMMARY OF THE INVENTION

In one aspect of the present invention, a device for draining a screw-on fluid filter comprises:

a hollow body member threadedly engaged with a puncturing member:

the hollow body member comprising:

a plurality of sides radially disposed about a central axis, the plurality of sides each having an outer surface separated from an inner surface by a thickness, wherein the outer surface of the plurality of sides defines a body member outer side and wherein the inner surface of the plurality of sides defines an internal conduit extending longitudinally along the central axis between a body member first end and a body member second end;

the body member first end comprising outer threads disposed into at least a portion of the body member outer side, the outer threads being coaxially arranged about the central axis, wherein the outer threads are dimensioned and arranged to at least partially engage a threaded attachment portion of the screw-on fluid filter; and wherein at least a portion of the internal conduit comprises inner threads disposed into at least a portion of the inner surface, the puncturing member comprising:

a shaft having a puncture end separated from a turning end, wherein at least a portion of the shaft is threaded, wherein at least a portion of the shaft is dimensioned such that the puncturing member threadedly engages the inner threads of the internal conduit such that rotating the puncturing member relative to the body member in a first rotational direction causes the puncture end to move away from the body member, and rotating the puncturing member relative to the body member in a second rotational direction causes the puncture end to move toward the body member.

In another aspect of the present invention, a device for draining a screw-on fluid filter comprises:

a hollow body member slidingly engagable with a puncturing member:

the hollow body member comprising:

a plurality of sides radially disposed about a central axis, the plurality of sides each having an outer surface separated from an inner surface by a thickness, wherein the outer surface of the plurality of sides defines a body member outer side and wherein the inner surface of the plurality of sides defines an internal conduit extending longitudinally along the central axis between a body member first end and a body member second end;

the body member first end comprising outer threads disposed into at least a portion of the body member outer side, the outer threads being coaxially arranged about the central axis, wherein the outer threads are dimensioned and arranged to at least partially engage a threaded attachment portion of the screw-on fluid filter;

the puncturing member comprising:

a shaft having a puncture end separated from a striking end, wherein at least a portion of the shaft is dimensioned such that the puncturing member slidingly engages the internal conduit, and wherein the puncture end comprises at least one tapered end.

In still another aspect of the present invention, a method of draining a screw-on fluid filter comprises the steps of:

attaching the body member first end of the above described device to a threaded attachment portion of a screw-on fluid filter;

rotating the puncturing member about the hollow body member in the first rotational direction in an amount necessary to puncture a portion of the screw-on fluid filter with the puncturing end of the puncturing member to produce a puncture hole in the screw-on fluid filter;

optionally rotating the puncturing member about the hollow body member in the second rotational direction in an amount required to allow fluid to drain from the puncture hole; and allowing the liquid in the screw-on fluid filter to drain through the puncture hole.

In still another aspect of the present invention, a method of draining a screw-on fluid filter comprises the steps of:

attaching the body member first end of the device of the above described device to the threaded attachment portion of the screw-on fluid filter;

contacting the striking end of the puncturing member with a force sufficient to puncture a portion of the screw-on fluid filter with the puncturing end of the puncturing member to produce a puncture hole in the screw-on fluid filter;

optionally removing at least a portion of the puncturing end from the puncture hole, and allowing the fluid in the screw-on fluid filter to drain through the puncture hole.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
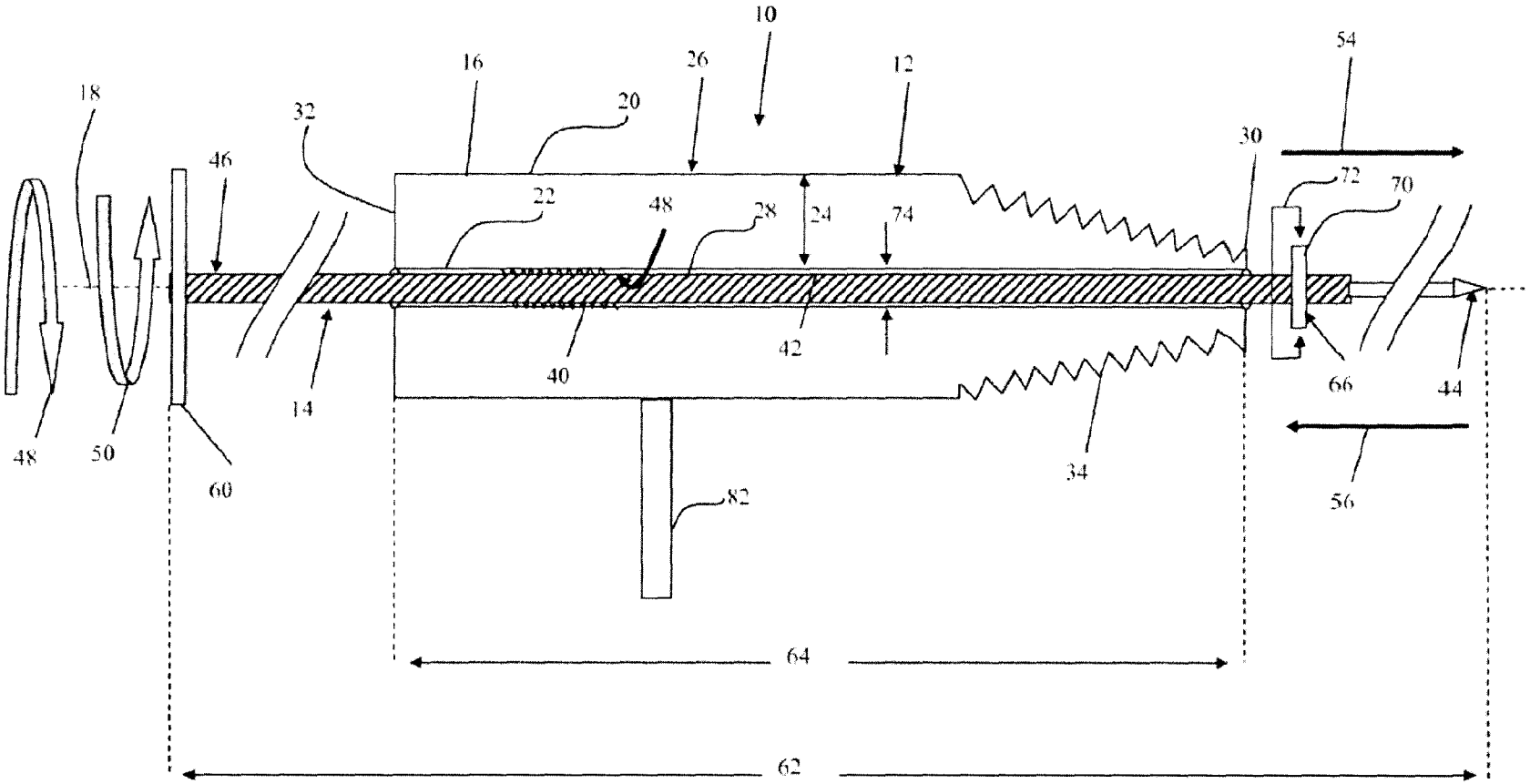
FIG. 1 is a cross-sectional view of an embodiment of the device of the instant disclosure.

The following detailed description is of the best currently contemplated modes of carrying out the invention. The description is not to be taken in a limiting sense, but is made merely for the purpose of illustrating the general principles of the invention, since the scope of the invention is best defined by the appended claims.

In the following description, numerous specific details are set forth to provide a thorough understanding of the present invention. However, it will be obvious to those skilled in the art that the present invention may be practiced without such specific details. In other instances, well-known devices have been shown in block diagram form in order not to obscure the present invention in unnecessary detail. For the most part, details unnecessary to obtain a complete understanding of the present invention have been omitted in as much as such details are within the skills of persons of ordinary skill in the relevant art.

Refer now to the drawings wherein depicted elements are not necessarily shown to scale and wherein like or similar elements are designated by the same reference numeral through the several views.

Broadly, the present invention generally provides a device for draining a screw-on fluid filter. As used herein, the term screw-on fluid filter includes fluid filters which are threadedly attached to at least a portion of a device in which they are used, and/or a manifold associated with such a device. The term screw-on fluid filter is not meant to be limiting to the type of filter with which the instant device may be used, but is used to convey a general type of filter utilized in the art to remove particulates from fluids. Examples of screw-on filters include oil filters commonly utilized on automobile and truck engines, in hydraulic systems, in refrigeration systems, and the like. Such filters include a threaded portion wherein the filter engages a corresponding manifold comprising one or more fittings from which a fluid (e.g., oil) is received into the filter and then subsequently returned to the engine or other device.

Referring now to FIG. 1, the device and/or apparatus for draining a screw-on fluid filter, generally referred to as 10, comprises a hollow body member 12 threadedly engaged with a puncturing member 14. In an embodiment, hollow body member 12 comprises a plurality of sides 16 radially disposed about a central axis 18, the plurality of sides 16 each having an outer surface 20 separated from an inner surface 22 by a thickness 24. In an embodiment, outer surface 20 of the plurality of sides 16 defines a body member outer side 26 and inner surface 22 of the plurality of sides 16 defines an internal conduit 28 extending longitudinally along central axis 18 between a body member first end 30 and a body member second end 32.

In an embodiment, body member first end 30 comprises outer threads 34 disposed into at least a portion of body member outer side 26. Outer threads 34 are preferably coaxially arranged about central axis 18. In an embodiment, outer threads 34 are dimensioned and arranged to at least partially engage a threaded attachment portion 36 of a screw-on fluid filter 38 (see FIG. 4.) In an embodiment, at least a portion of internal conduit 28 comprises inner threads 40 disposed into at least a portion of inner surface 22.

Puncturing member 14 comprises a shaft 42 having a puncture end 44 separated from a turning end 46. In an embodiment, at least a portion of shaft 42 comprises threads 48 and at least a portion of shaft 42 may be dimensioned such that the puncturing member 14 threadedly engages inner threads 40 of internal conduit 28 such that rotating puncturing member 14 relative to body member 12 in a first rotational direction 48 causes puncture end 44 to move in a first direction 54 away from body member 12 along central axis 18; likewise, rotating puncturing member 14 relative to body member 12 in a second rotational direction 50 causes puncture end 44 to move in a second direction 56 toward body member 12 along central axis 18.

In an embodiment, body member first end 30 may be frusta-conical, and outer threads 34 may be tapered.

Figure 2A:
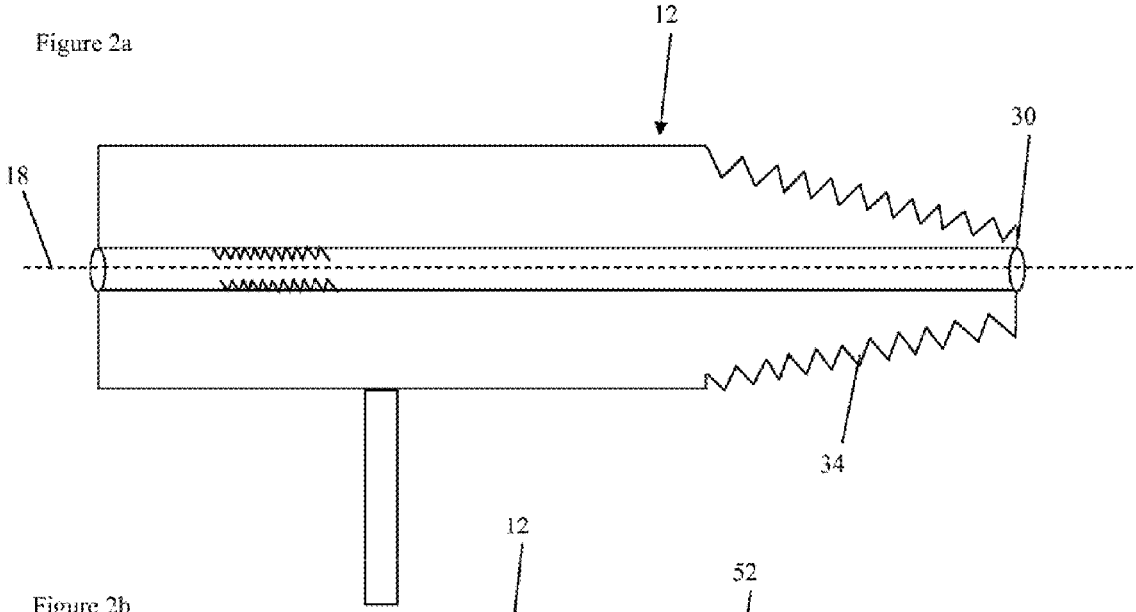
FIG. 2*a* is a cross-sectional view of an embodiment of the hollow body member of the device of the instant disclosure having a continuously tapered first end.
Figure 2B:
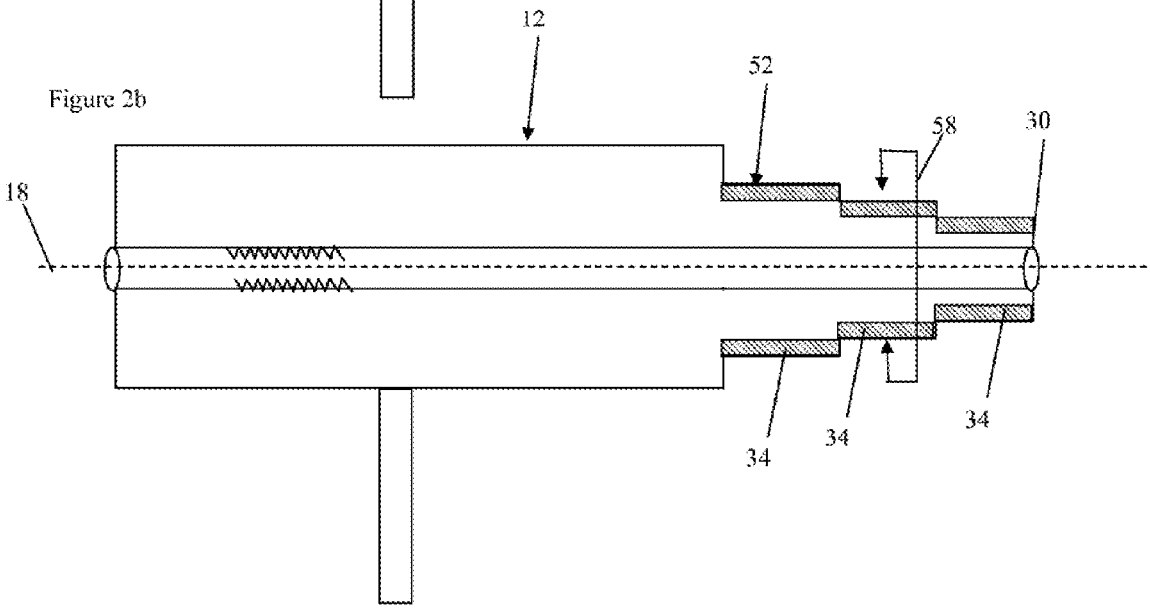
FIG. 2*b* is a cross-sectional view of an embodiment of the hollow body member of the device of the instant disclosure having a stepped tapered first end.

As shown in the embodiment depicted in FIG. 2*a*, at least a portion of first end 30 may be continuously tapered. As shown in the embodiment depicted in FIG. 2*b*, at least a portion of first end 30 may be discontinuously tapered in a plurality of steps 52, wherein each of the plurality of steps 52 has a different step diameter 58 and/or outer threads 34 which correspond to various attaching portions 36 of various fluid filters 38 (shown generally in FIG. 4.)

Figures 3A, 3B, 3C:
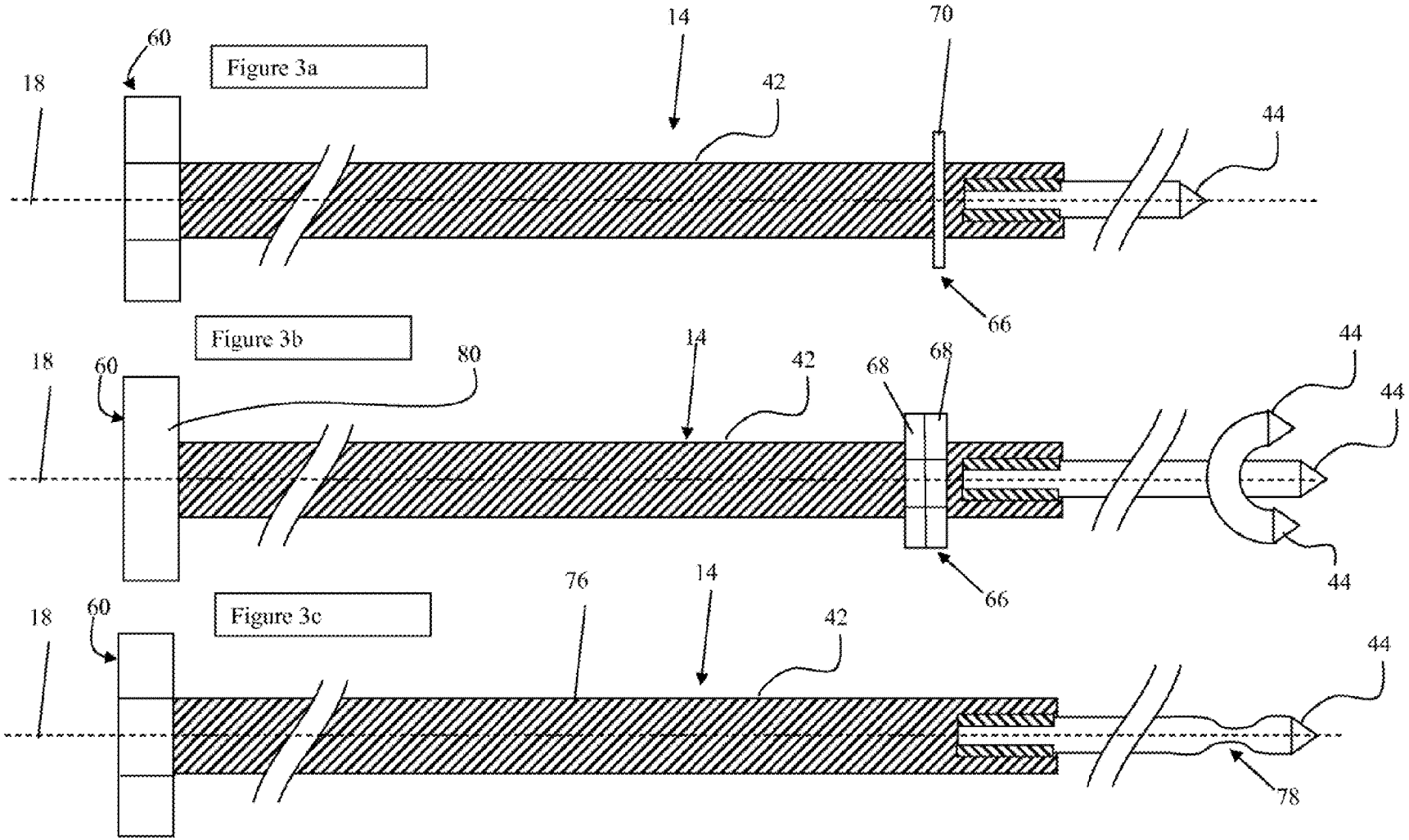
FIGS. 3*a*, 3*b*, and 3*c* are cross-sectional views of embodiments of the puncturing member of the device of the instant disclosure.

In an embodiment of the instant device, turning end 46 may comprise a handle 60 which preferably may depend essentially orthogonal to central axis 18. As shown in FIG. 1, handle 60 may be a T-handle. As shown in FIG. 3*a*, handle 60 may be a hexagonal top, preferable dimensioned to engage a standard sized wrench commonly used in the art. In another embodiment, the handle may be dimensioned and arranged to receive the male portion of a standard ⅜" or ½" drive socket wrench, referred to herein as a socket wrench top. As shown in FIG. 3*b*, handle 60 may include a ratcheting mechanism 80 to form a ratcheting top, commonly in use in the automotive arts. Handle 60 may include any number of sides e.g., square, hexagonal, octagonal, or the like, and may include any combination of geometries and arrangements as desired.

Figure 5A:
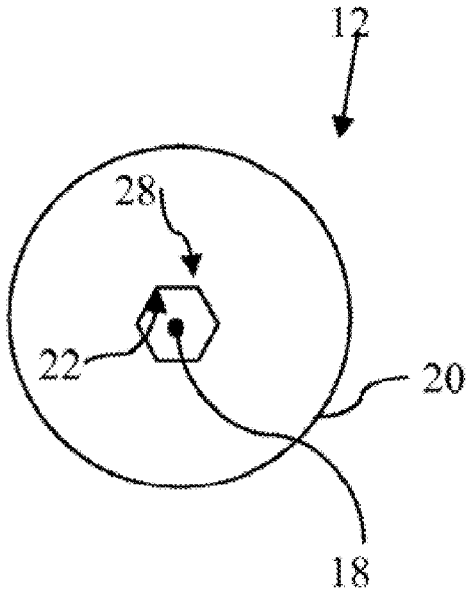
FIGS. 5*a* and 5*b* are cross-sectional views of embodiments of the hollow body member taken orthogonal to the central axis.
Figure 5B:
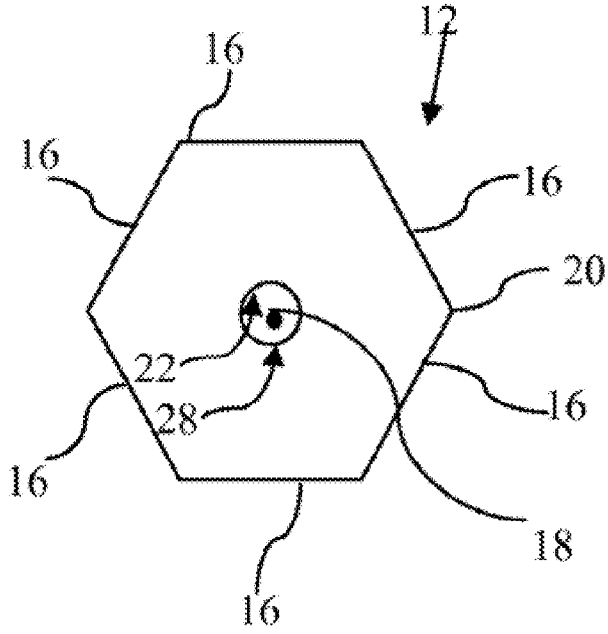

As shown in FIG. 5*a*, in an embodiment, a cross-section of a portion of hollow body member 12 taken orthogonal to central axis 18 may be circular; as shown in FIG. 5*b*, in an embodiment, a cross-section of a portion of hollow body member 12 taken orthogonal to central axis 18 may comprise a limited number of sides, preferably 4, 6 or 8 sides; or any combination thereof independent of the cross-section of internal conduit 28. Likewise, a cross-section of a portion of internal conduit 28 taken orthogonal to central axis 18 may be circular, may comprise a limited number of sides, preferably 4, 6 or 8 sides, or any combination thereof independent of outer surface 20. Any combination of cross-sectional geometries are contemplated in the instant disclosure. In an embodiment, outer surface 20 may be textured, e.g., knurled, coated, and/or the like, in a way designed to enhance the ability to grasp and retain the instant device, by methods known to one of skill in the art.

As shown in FIG. 1, in an embodiment, puncturing member 14 may have a length 62 which is longer than a length 64 of hollow body member 12.

In an embodiment, a portion of puncturing member 14 located between turning end 46 and puncture end 44 may comprise a stopping block 66, such that when stopping block 66 is engaged with shaft 42, puncturing member 14 engaged with hollow body member 12 cannot be removed from hollow body member 12. As shown in FIG. 3*b*, in an embodiment, stopping block 66 may include one or more stop nuts 68 threadedly attached to shaft 42, and/or as shown in FIG. 3*a*, a pin 70 may be disposed through shaft 42 of puncturing member 14, and/or as shown in FIG. 1, puncturing member 14 may include an enlarged portion 72 of shaft 42 having a shaft diameter 72 larger than a diameter 74 of internal conduit 28, or any combination thereof. Preferably, stopping block 66 is removable from shaft 42 to allow for removal of puncturing member 14 from hollow body member 12.

As shown in FIGS. 3*a*, 3*b*, and 3*c*, in an embodiment puncture end 44 may be threadedly engaged with, and removable from shaft 42.

In an embodiment, hollow body member 12 may comprise at least one handle member 82, preferably depending outward from outer surface 20, preferably essentially orthogonal to central axis 18.

As shown in FIG. 3*c*, the diameter of a portion of puncturing member 14 proximate to puncture end 44 may decreases at least once, increases at least once, and then decreases at least once from a center point 76 of shaft 42 to puncture end 44 to form a step 78. Accordingly, upon puncturing of a filter with puncture end 44, step 78 allows for fluid to drain from a punctured filter without removing puncture end 44 from the puncture hole produced through a punctured filter housing (see FIG. 4.) As shown in FIG. 3*b*, in an embodiment, puncture end may include a plurality of ends 44, preferably aligned parallel to central axis 18.

Puncture end 44, puncturing member 14, and/or hollow body member 12 may comprise metal, preferably aluminum, steel, stainless steel, or any combination thereof, and/or one or more layers of a polymeric resin. Puncture end 44 may include hardened steel, silicon carbide, diamond, and/or the like to facilitated puncturing of a filter housing. Puncture end 44 is preferably tapered to a point, preferably at an angle of between about 10° to about 80° relative to central axis 18, more preferably at an angle of about 40° to about 60° relative to central axis 18.

Figure 6:
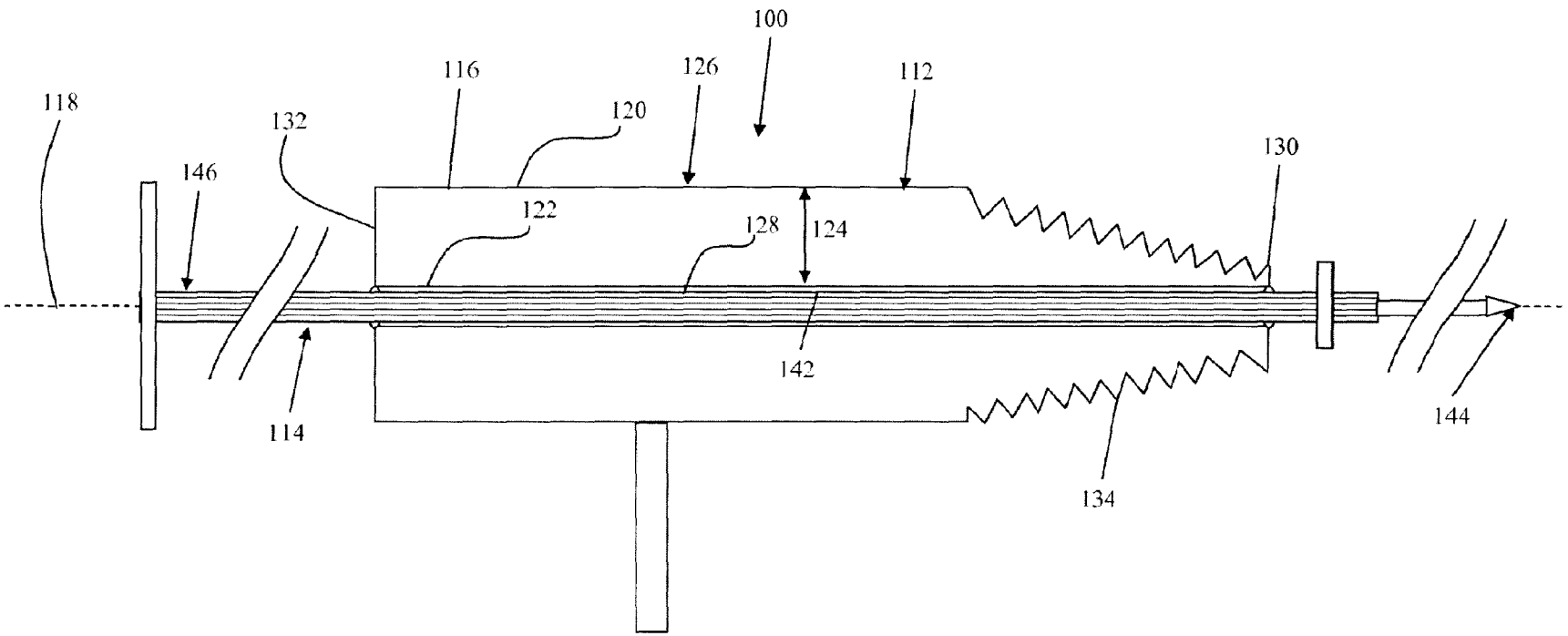
FIG. 6 is an alternate embodiment of the device of the instant disclosure.

In an embodiment the device for draining a screw-on fluid filter of the instant disclosure may comprise a hollow body member slidingly engagable with a puncturing member, generally referred to as 100 as shown in FIG. 6. In such an embodiment, all of the subsequent limitations discussed herein may apply to the instant device, so long as the hollow body member is slidingly engaged with the puncturing member. Accordingly, in an embodiment, hollow body member 112 comprises a plurality of sides 116 radially disposed about a central axis 118, the plurality of sides 116 each having an outer surface 120 separated from an inner surface 122 by a thickness 124. In an embodiment, outer surface 120 of the plurality of sides 116 defines a body member outer side 126 and inner surface 122 of the plurality of sides 116 defines an internal conduit 128 extending longitudinally along central axis 118 between a body member first end 130 and a body member second end 132. In an embodiment, body member first end 130 comprises outer threads 134 disposed into at least a portion of body member outer side 126. Outer threads 134 are preferably coaxially arranged about central axis 118. In an embodiment, outer threads 134 are dimensioned and arranged to at least partially engage a threaded attachment portion 36 of a screw-on fluid filter 38 (see FIG. 4.)

Puncturing member 114 comprises a shaft 142 having a puncture end 144 separated from a striking end 146. In an embodiment, at least a portion of shaft 142 is dimensioned such that puncturing member 114 slidingly engages internal conduit 128. Preferably, puncture end 144 comprises at least one tapered end and/or at least one point.

In an embodiment, a method of draining a screw-on fluid filter comprises the steps of:

engaging and/or otherwise attaching the instant body member first end of the instant device to a threaded attachment portion of a screw-on fluid filter;

engaging the puncturing member with an inner surface of the fluid filter such that the puncturing end of the puncturing member protrudes through a surface of the fluid filter from an inner side of the fluid filter to an outer side of the fluid filter, to produce a puncture hole through the fluid filter; and allowing fluid in the punctured fluid filter to drain from the fluid filter.

Figure 4:
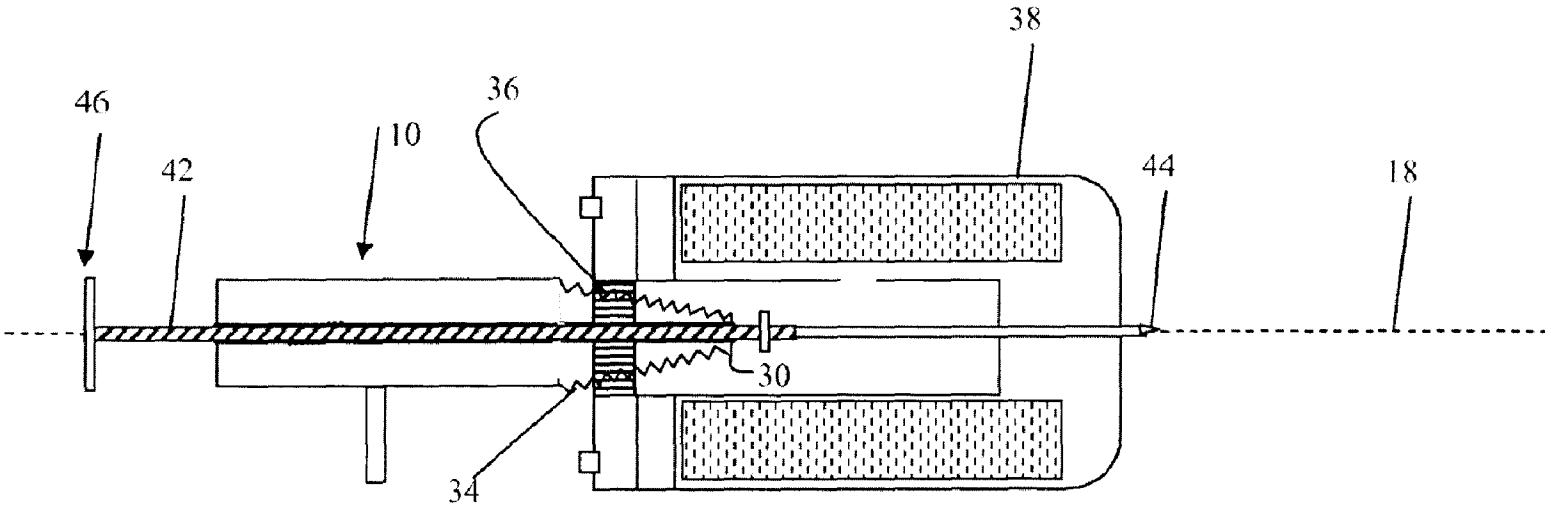
FIG. 4 is a cross-sectional view of an embodiment of the device of the instant disclosure attached to a screw-on oil filter.

In an embodiment, the step of engaging the puncturing member with an inner surface of the fluid filter may include rotating the puncturing member about the hollow body member in the first rotational direction in an amount necessary to move the puncturing member in a first direction along the central axis in an amount sufficient to puncture a portion of the screw-on fluid filter with the puncturing end of the puncturing member to produce a puncture hole in the screw-on fluid filter (see FIG. 4);

optionally rotating the puncturing member about the hollow body member in the second rotational direction in an amount sufficient to move the puncturing member in a second direction along the central axis in an amount sufficient to remove at least a portion of the puncturing member from the puncture hole to allow fluid to drain from the inner area of the fluid filter, through the puncture hole and out of the fluid filter.

In an embodiment, the step of engaging the puncturing member with an inner surface of the fluid filter may include contacting the striking end of the puncturing member with a force sufficient to puncture a portion of the screw-on fluid filter with the puncturing end of the puncturing member to produce a puncture hole in the screw-on fluid filter; optionally removing at least a portion of the puncturing end from the puncture hole, and allowing the liquid in the screw-on fluid filter to drain through the puncture hole.

It should be understood, of course, that the foregoing relates to preferred embodiments of the invention and that modifications may be made without departing from the spirit and scope of the invention as set forth in the following claims.

We claim:

1. A device for draining a screw-on fluid filter comprising:

a hollow body member threadedly engaged with a puncturing member:

the hollow body member comprising:

a plurality of sides radially disposed about a central axis, the plurality of sides each having an outer surface separated from an inner surface by a thickness, wherein the outer surface of the plurality of sides defines a body member outer side and wherein the inner surface of the plurality of sides defines an internal conduit extending longitudinally along the central axis between a body member first end and a body member second end;

the body member first end comprising outer threads disposed into at least a portion of the body member outer side, the outer threads being coaxially arranged about the central axis, wherein the outer threads are dimensioned and arranged to at least partially engage a threaded attachment portion of the screw-on fluid filter; and wherein at least a portion of the internal conduit comprises inner threads disposed into at least a portion of the inner surface, the puncturing member comprising:

a shaft having a puncture end separated from a turning end, wherein at least a portion of the shaft is threaded, wherein at least a portion of the shaft is dimensioned such that the puncturing member threadedly engages the inner threads of the internal conduit such that rotating the puncturing member relative to the body member in a first rotational direction causes the puncture end to move away from the body member, and rotating the puncturing member relative to the body member in a second rotational direction causes the puncture end to move toward the body member.

2. The device of claim 1, wherein the body member first end is frusta-conical, and the outer threads are tapered.

3. The device of claim 2, wherein at least a portion of the first end is continuously tapered.

4. The device of claim 2, wherein at least a portion of the first end is discontinuously tapered in a plurality of steps, wherein each of the plurality of steps has a different diameter.

5. The device of claim 1, wherein the turning end comprises a handle depending essentially orthogonal to the central axis.

6. The device of claim 5, wherein the handle is a T-handle, a square, hexagonal or octagonal top, a ratcheting top, socket wrench top, or a combination thereof.

7. The device of claim 1, wherein a cross-section of the hollow body member taken orthogonal to the central axis is circular.

8. The device of claim 1, wherein a cross-section of the hollow body member taken orthogonal to the central axis comprises 4, 6, or 8 sides.

9. The device of claim 1, wherein the puncturing member is longer in length than the hollow body member.

10. The device of claim 5, wherein a portion of the puncturing member located between the turning end and the puncture end comprises a stopping block, such that the puncturing member cannot be removed from the hollow body member.

11. The device of claim 10, wherein the stopping block comprises one or more stopping nuts attached to the shaft, a pin disposed through the puncturing member, an enlarged portion of the shaft having a diameter larger than the diameter of the internal conduit, or a combination thereof.

12. The device of claim 1, wherein the puncture end comprises at least one tapered end.

13. The device of claim 1, wherein the puncture end is threadedly engaged with, and removable from the shaft.

14. The device of claim 1, wherein the hollow body member comprises at least one handle member depending outward from the body member outer side essentially orthogonal to the central axis.

15. The device of claim 1, wherein the diameter of the puncturing member decreases at least once, increases at least once, and then decreases at least once from a center point of the shaft to the puncture end.

16. A method of draining a screw-on fluid filter comprising the steps of:

providing a device for draining a screw-on fluid filter according to claim 1;

attaching the body member first end of the device for draining a screw-on fluid filter to a threaded attachment portion of the screw-on fluid filter;

rotating the puncturing member about the hollow body member in the first rotational direction in an amount necessary to puncture a portion of the screw-on fluid filter with the puncturing end of the puncturing member to produce a puncture hole in the screw-on fluid filter;

optionally rotating the puncturing member about the hollow body member in the second rotational direction in an amount required to allow fluid to drain from the puncture hole; and allowing the fluid in the screw-on fluid filter to drain through the puncture hole.

17. A device for draining a screw-on fluid filter comprising:

a hollow body member slidingly engagable with a puncturing member:

the hollow body member comprising:

a plurality of sides radially disposed about a central axis, the plurality of sides each having an outer surface separated from an inner surface by a thickness, wherein the outer surface of the plurality of sides defines a body member outer side and wherein the inner surface of the plurality of sides defines an internal conduit extending longitudinally along the central axis between a body member first end and a body member second end;

the body member first end comprising outer threads disposed into at least a portion of the body member outer side, the threads being coaxially arranged about the central axis, wherein the threads are dimensioned and arranged to at least partially engage a threaded attachment portion of the screw-on fluid filter;

the puncturing member comprising:

a shaft having a puncture end separated from a striking end, wherein at least a portion of the shaft is dimensioned such that the puncturing member slidingly engages the internal conduit, and wherein the puncture end comprises at least one tapered end.

18. The device of claim 17, wherein the body member first end is frusta-conical, and the outer threads are tapered.

19. The device of claim 17, wherein at least a portion of the first end is continuously tapered.

20. A method of draining a screw-on fluid filter comprising the steps of:

providing a device for draining a screw-on fluid filter according to claim 17;

attaching the body member first end of the device for draining a screw-on fluid filter to a threaded attachment portion of the screw-on fluid filter;

contacting the striking end of the puncturing member with a force sufficient to puncture a portion of the screw-on fluid filter with the puncturing end of the puncturing member to produce a puncture hole in the screw-on fluid filter;

optionally removing at least a portion of the puncturing end from the puncture hole, and allowing the fluid in the screw-on fluid filter to drain through the puncture hole.

* * * * *